US006431437B1

(12) United States Patent
Lombardo et al.

(10) Patent No.: US 6,431,437 B1
(45) Date of Patent: Aug. 13, 2002

(54) Z-FOLD MAILER WITH BUILT-IN RETURN ENVELOPE

(75) Inventors: Leo Lombardo, Manchester, NH (US); Paul Morrison, North Attleboro, MA (US)

(73) Assignee: Moore North America, Grand Island, NY (US)

( * ) Notice: Subject to any disclaimer, the term of this patent is extended or adjusted under 35 U.S.C. 154(b) by 0 days.

(21) Appl. No.: 09/820,643

(22) Filed: Mar. 30, 2001

(51) Int. Cl.[7] ..... B65D 27/06
(52) U.S. Cl. ..... 229/305; 229/92.1
(58) Field of Search ..... 229/306, 305, 229/301, 92.1, 316

(56) References Cited

U.S. PATENT DOCUMENTS 4,669,652 A * 6/1987 Seguin ..... 229/306 X
4,715,531 A * 12/1987 Stewart et al. ..... 229/306
4,915,287 A 4/1990 Volk et al.
5,104,036 A 4/1992 Rutkowski et al.
5,289,972 A * 3/1994 Sauerwine et al. .... 229/92.1 X
5,376,048 A * 12/1994 Whiteside ..... 229/92.1 X
5,402,934 A 4/1995 Sauerwine
5,513,795 A 5/1996 Sauerwine
5,642,855 A 7/1997 Michlin
6,003,760 A * 12/1999 Abercrombie ..... 229/92.1 X

FOREIGN PATENT DOCUMENTS

FR 2377941 * 9/1978 ..... 229/306

* cited by examiner

*Primary Examiner*—Jes F. Pascua
(74) *Attorney, Agent, or Firm*—Nixon & Vanderhye PC

(57) ABSTRACT

An intermediate for a mailer type business form is provided that is Z-folded to produce a mailer type business form with built-in reply envelope. A large area is provided for printing statement, remittance and/or other information and yet the reply envelope produced accepts a conventional size personal check without folding. This is accomplished by providing a re-wettable adhesive for forming and sealing the reply envelope. The outgoing address indicia is imaged on the top face of one of the panels that forms the return envelope so that the outgoing address is concealed when the reply envelope is formed. The reply address indicia is imaged on the bottom face on the second panel defining the reply envelope so that when the reply envelope is formed, the reply address is the only exposed address on the reply envelope.

17 Claims, 5 Drawing Sheets

Z-FOLD MAILER WITH BUILT-IN RETURN ENVELOPE

BACKGROUND AND SUMMARY OF THE INVENTION

Mailer type business forms must serve a wide variety of customer requirements. Several features that are almost universally desirable include the ability to print on a large amount of the mailer, a built-in reply envelope that accepts a conventional size personal check without folding, a statement portion, and a remittance coupon or stub portion for being returned along with the check remittance.

Fourteen-inch, pressure seal Z-fold built-in return envelope products are conventionally imaged on a laser printer in the simplexed mode (one side only). From a print processing standpoint, this is an advantage. However, because the document is simplexed, there is not much space available for variable imaging. These areas generally include room for a statement or invoice, room for a remittance coupon or stub portion, and room to create the return envelope. With conventional three panel documents, one panel is used for the outgoing address panel and the two remaining panels are used to meet the remaining requirements of the mailer. More specifically, on conventional existing pressure seal Z-fold return constructions, the face of the top panel is generally used for both the remittance and the statement or invoice, the middle panel is used to create one side of the return envelope and the bottom is used to create the second side of the return envelope. Pressure seal adhesive or co-adhesive is provided on one and/or the other of the middle panel and bottom panel so that when the Z-fold mailer is formed, the return envelope is simultaneously created. Accordingly, to remit payment, the customer removes the combined statement/remittance portion, severs the remittance stub and inserts it in the reply envelope together with the personal check remittance. A re-wettable adhesive is typically provided on the reply envelope flap, which is folded to the back of the reply envelope to seal the remittance therein.

In the above-described 14 inch, Z-fold return mailer construction, the bottom panel serves a dual purpose. It bears the outgoing address and the side having the outgoing address defines the backside of the return envelope when the mailing is Z-folded. As a result, however, part of the outgoing address is visible on the backside of the return envelope. Some Z-fold mailers have been configured to minimize or eliminate the exposed outgoing address. For example, U.S. Pat. No. 5,513,795, the entire disclosure of which is incorporated herein by this reference, provides a construction wherein part of the outgoing address is removed by tearing along a line of weakness and the remaining portion of the outgoing address is obscured or covered when the reply envelope is sealed. Nevertheless, with this and other conventional Z-folds, the return mailer envelope is generally a side open construction or side sealing envelope construction. A top open or top sealing construction is not possible with this pressure Z-fold construction simply because there is a lack of space.

It is an object of the invention to provide, e.g., a 14-inch, pressure seal Z-fold return envelope construction that can be used on all pressure seal folding/sealing hardware, that provides additional room for variable information, and that provides a top open return envelope making the product friendlier and more versatile to the end user. According to the present invention, an intermediate for a mailer type business form and the mailer itself are provided which achieves the objectives set forth above. The intermediate comprises a single quadrate sheet of paper, which may be easily run through a printer to print indicia on either one or both faces. In an exemplary embodiment, the outgoing address and the reply address are on different faces of the intermediate and thus where adapted to printing in the simplexed mode, only the outgoing address is variably imaged. The intermediate may be easily Z-folded to form the final mailer and sealed by conventional techniques. The mailer is easy to open and the reply envelope is easy to assemble and utilize.

According to an embodiment of the invention, the face of the document has three equal panels, one panel, for example the top panel, is used for the statement or invoice. A second panel, for example the middle panel is provided to serve a dual purpose. It defines a remittance piece or portion and one panel or side of the return envelope. Because the remittance is provided on the second panel, it allows for more room for the statement on the first panel. The third panel, for example the bottom panel, also serves a dual purpose. It is provided as the face of the outgoing mail piece and also defines the second panel of the return envelope, with the face that defined the outgoing mail piece serving as the inside of the return mailer. As the result, the outgoing address is not exposed on the reply envelope.

In an exemplary embodiment, the back the three panel document includes opening instructions, for example, on the first, top panel; includes a preprinted return address, preferably on the second, middle panel; and in an exemplary embodiment, the third, bottom panel is the back of the return mail piece, on which an advertisement or other information may be provided.

The intermediate for the business form provided according to the invention is imaged in the simplexed mode and then folded and sealed in a conventional manner. When the end user receives the document, the two vertical sides are removed and then the remainder of the document is opened by breaking adhesive regions defined at the top and bottom, using a letter opener, index finger, or the like. The statement is then detached from the document and retained by the end user. The recipient fills out the remittance portion defined on one of the two panels of the reply envelope. Folding the second and third panels defines the return mailer. A stub portion located at the bottom of the form is removed to define the back of the return mail piece. The end user then activates, e.g., by wetting an adhesive defined at the two sides of the second panel and adheres the second and third panels to create the return envelope. A check is then inserted into the return envelope and the envelope is sealed by wetting the adhesive flap of the reply envelope and applying it to the back of the return/reply mail piece. No remittance stub or portion needs to be enclosed with the check because it is integrated in the reply envelope.

As is apparent from the foregoing, the invention overcomes a number of barriers and satisfies the requirements of a mailer-type business form. The construction of the invention can be used on all folding/sealing equipment that is currently available. It allows the check to be placed in the return envelope without folding and provides a top open return envelope, which gains wide customer acceptance. By incorporating the remittance portion on one panel of the reply envelope, more room is allowed for the statement or invoice. There is no chance of the remittance portion being lost or inadvertently omitted, as it is an integrated part of the reply envelope. Further, because the panel bearing the outgoing address defines a part of the reply envelope, so that the outgoing addresses is on the inside of the reply envelope, no outgoing address is showing on the reply envelope.

Finally, the construction of the invention can be imaged in a simplexed mode, which from a print processing is an advantage, since all variable information can be provided on one face of the intermediate.

Thus, according to one aspect of the present invention, an intermediate for a mailer type business form comprises the following components: a substantially opaque quadrate sheet of paper having parallel top and bottom edges, parallel first and second side edges perpendicular to the top and bottom edges and first and second faces. First and second fold lines are defined parallel to the top and bottom edges and divide the sheet into substantially equal-sized first, second and third panels. In the illustrated embodiment, the first panel is defined between the top edge of the intermediate and the first fold line, the third panel is defined between the bottom edge and the second fold line, and the second panel is defined between the first and third panels. An outgoing address is provided on the first face of the third panel. The outgoing address area is of a size and material suitable for receiving outgoing address indicia either by directly printing on the form or by adhesive label application. A reply address area is defined on the second face of the second panel. The reply address is typically preprinted on the intermediate but may be variably printed where the mailer is imaged in a duplex mode. Like the outgoing address area, the reply address area is of a size and material suitable for receiving an address printed thereon or the application of an adhesive address label (printed or written). Permanent adhesive patterns are provided on the first face of the first and/or second panels and on the second face of the second and/or third panels for fixedly adhering the mailer in a Z-folded configuration when the first, second and third panels are Z-folded about the first and second fold lines. Another permanent adhesive pattern, preferably including dots or strips of adhesive is disposed on the first face of the first panel adjacent the top edge thereof and/or on the first face of the second panel along and adjacent the second fold line and further on the second face of the second panel adjacent the first fold line and/or on the second face of the third panel adjacent the bottom edge of the mailer for securing the top and bottom edges of the Z-folded mailer.

First and second lines of weakness are formed in the first through third panels parallel to and spaced from each of the first and second side edges. These lines of weakness define tear-off strips providing for ready opening of a mailer constructed by Z-folding the sheet along the fold lines.

Re-wettable or otherwise activatable adhesive patterns are provided on the first face of the second panel for defining the second and third panels into a reply envelope. A reply envelope closing flap is defined by a portion of the second panel and has an activatable, for example re-wettable, adhesive on the first face thereof for sealing the reply envelope. A line of weakness is formed in the third panel parallel to the bottom edge and spaced from the bottom edge as to define a removable stub generally corresponding to or slightly larger than the reply envelope closing flap for being removed when the reply envelope is formed.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
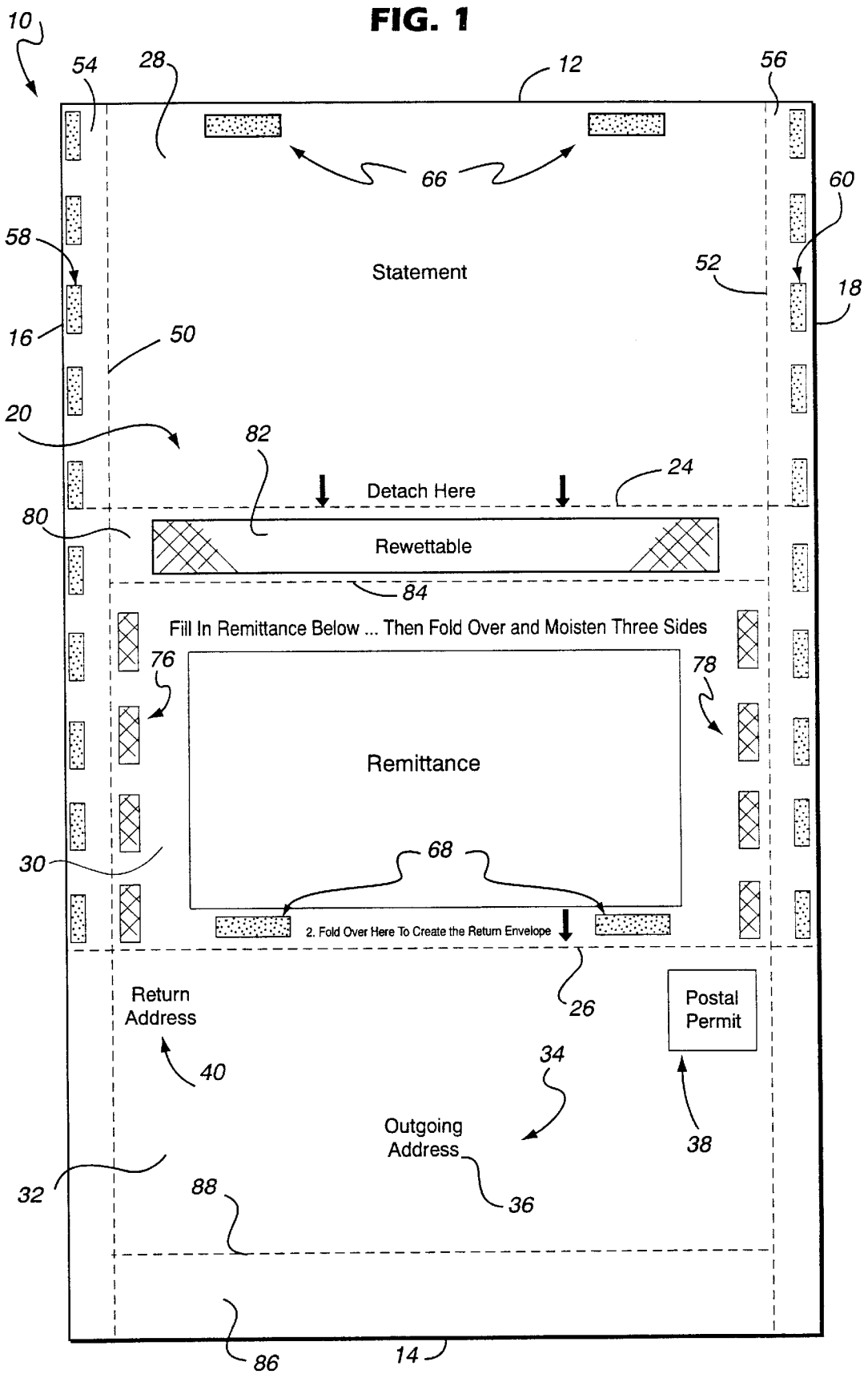
FIG. 1 is a top plan view of a first face of an exemplary intermediate according to the present invention.
Figure 2:
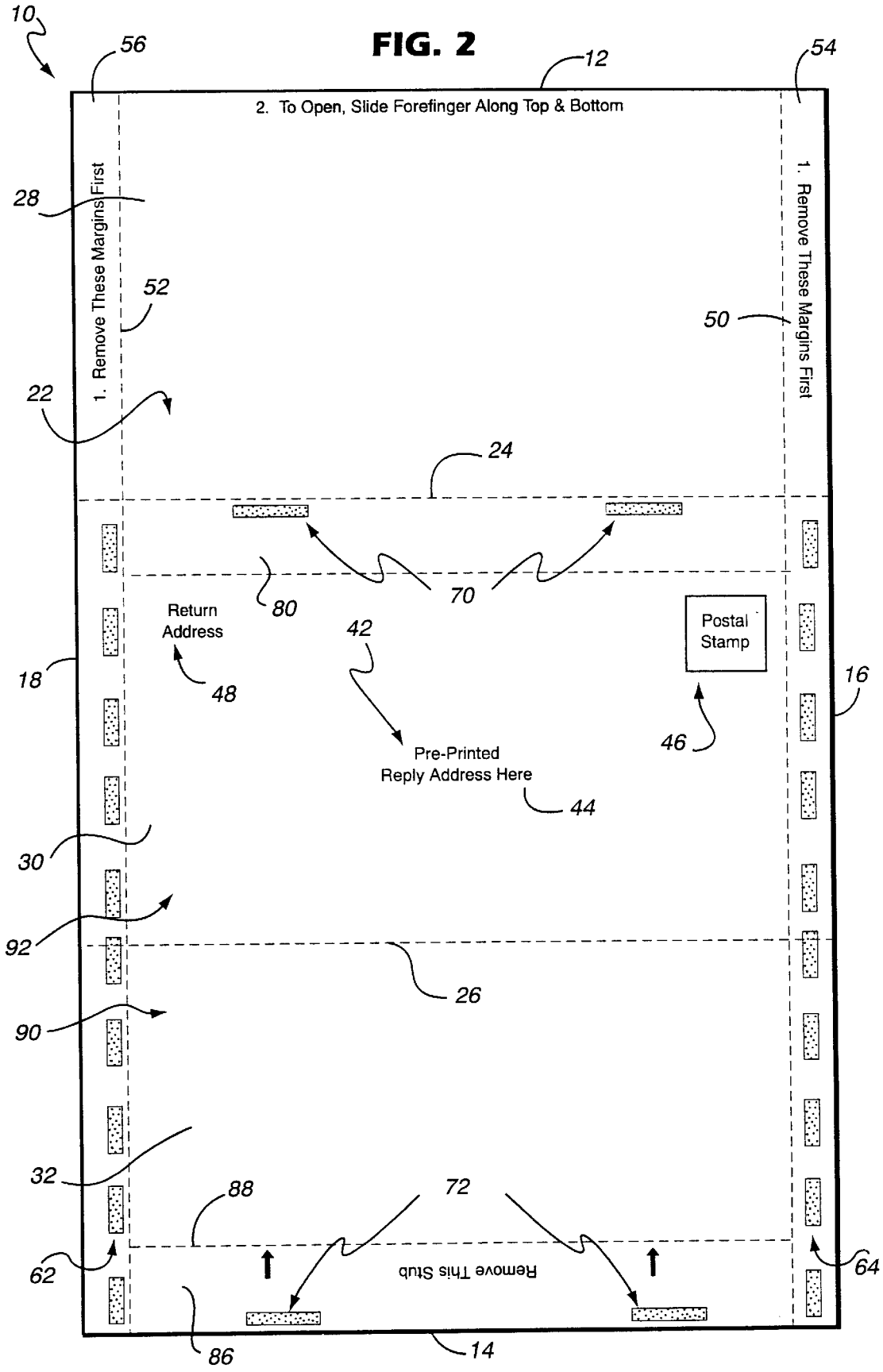
FIG. 2 is a plan view of the second face of the intermediate of FIG. 1.

An exemplary intermediate for a mailer type business form is shown generally by reference number 10 in FIGS. 1 and 2. It includes a quadrate sheet of substantially opaque paper (i.e., no windows and not fully translucent) having parallel top and bottom edges 12,14 and parallel first and second side edges 16,18, respectively. The side edges are perpendicular to the top and bottom edges. The sheet is further defined to include first and second faces 20,22 (FIG. 1 and FIG. 2), respectively. First and second fold lines 24,26 are provided parallel to the top and bottom edges dividing the sheet of the intermediate into three substantially three-equal size panels 28,30,32.

With reference to the presently preferred, illustrated embodiment, the first panel 28 is disposed as the top panel of the form, the second panel 30 is disposed as the middle panel and the third panel 32 is disposed as the bottom panel of the form so that the second panel is between the first and third panels. Thus, the first panel 28 is between the top edge 12 and the first fold line 24, the second panel 30 is between fold lines 24 and 26 and the third panel is between fold line 26 and the bottom edge 14 of the intermediate 10. Fold lines 24,26 may comprise lines of weakness such as perforation lines or die cut lines or may merely be scored or crease lines. In the presently preferred embodiment where the first panel 28 is adapted to be removed and retained by the end user, the fold line 24 is preferably a line of weakness that facilitates separation of the first panel from the second panel. Furthermore, in the presently preferred embodiment, the second and third panels 30,32 together define the reply envelope and therefore, the second fold line is not adapted to be severed by the end user. However, that line of weakness may in due course be severed by the recipient of the remittance. As will become apparent below, the invention is not limited to the described series and orientation of the panels, except as required by the appended claims.

The intermediate also includes an outgoing address area 34 on the first face of the third panel 32. The outgoing address area is of a size and defined by a media to receive e.g., a laser printed address or preprinted address label. The outgoing address area can include indicia corners or other indicator such as a change in texture, tone or color of the paper to facilitate the determination of the proper location of the outgoing address. Such indicators, however, are not critical to the effective implementation of the invention. Human readable address indicia, as shown only schematically by indicia 36 in FIG. 1, is ultimately imaged on the intermediate such as after it has passed through the laser printer. Other human or machine readable indicia may also be preprinted on the first face of the third panel, such as a postal address bar coding (not shown), indicia 38 for postal stamp application and/or indicia 40 for the sender's return address.

The intermediate also defines a reply address area 42 on the second face 22 of the intermediate 10, that is the face opposite to the face 20 having the outgoing address area 34, but in the region defined by the second panel 30. The reply address area 42 is of a size and media suitable for receiving human readable address indicia. Again, corner indicia or other print area designators, as described above with reference to the outgoing address area 34, may be provided to indicate the most preferred location of the reply address. In the presently preferred embodiment, the reply address indicia 44 is preprinted in the reply address area 42 but the indicia may be variably printed thereon or applied as a preprinted address label without departing from the concept of the invention. Thus, at some point, human readable reply address indicia shown schematically at 44 in FIG. 2 is imaged in the return address area 42. Other human or machine readable indicia may also be preprinted on the second face 22 of the second panel 30, such as a postal address bar coding (not shown), indicia for postal stamp application 46 and/or indicia 48, such as blank lines (not shown) for the end user to apply their own return address to the reply envelope.

Figure 4:
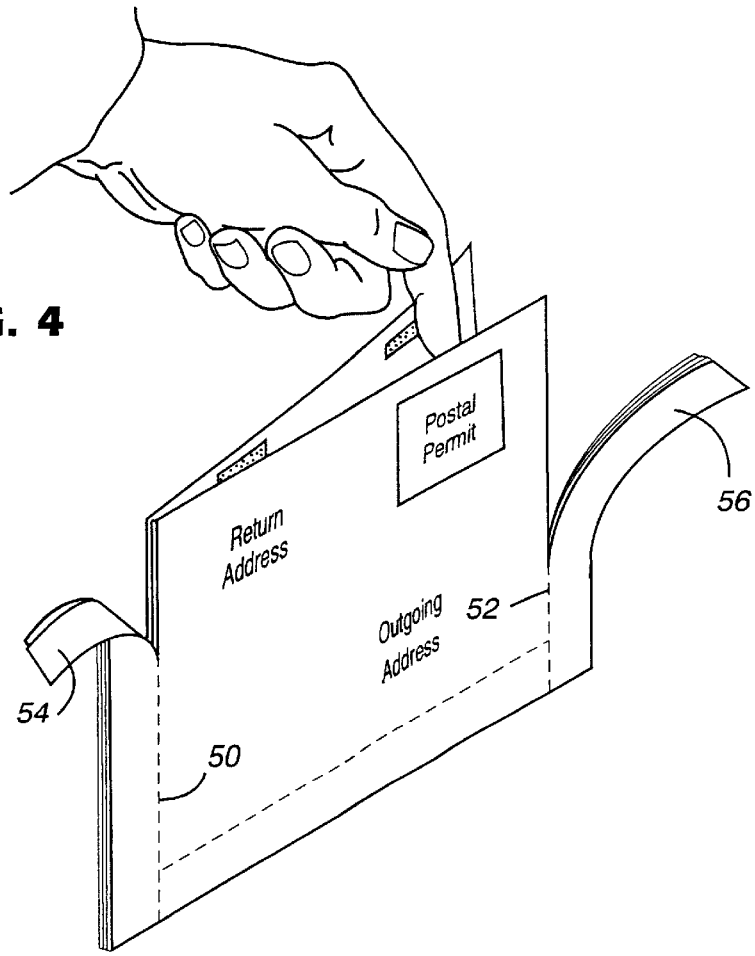
FIG. 4 is a perspective view showing the opening of the mailer of FIG. 3 by the end user.

First and second lines of weakness 50,52 are formed in the first through third panels parallel to and spaced from each of the edges 16,18. The first and second lines of weakness 50,52 define tear off strips 54,56 providing for ready opening of a mailer constructed by Z-folding the sheet of the intermediate about fold lines 24 and 26, as shown in FIG. 4.

Figure 3:
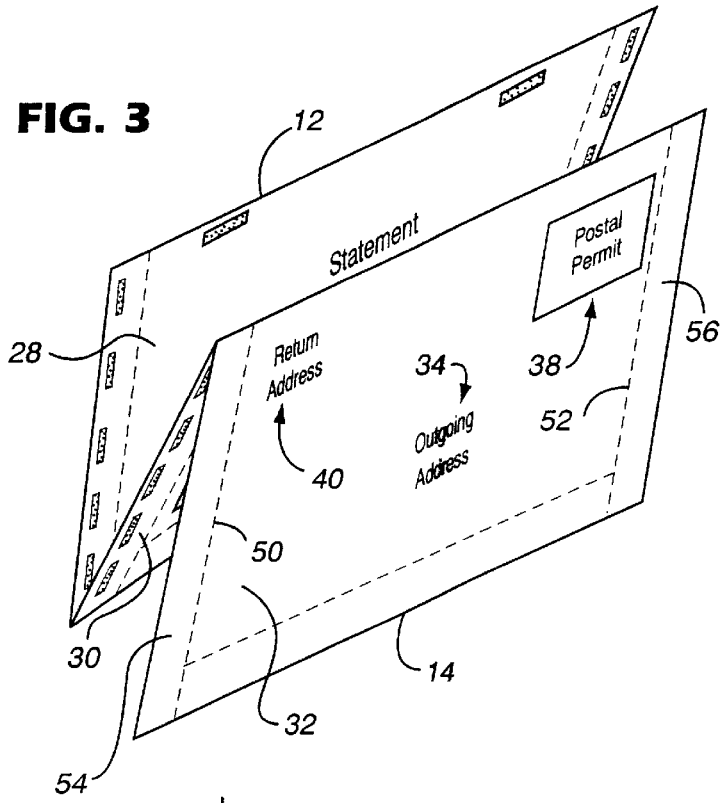
FIG. 3 is a top perspective view showing the intermediate of FIGS. 1 and 2 being folded into a mailer type business form.

The intermediate comprises a plurality of adhesive patterns provided in at least some of the tear off strips for holding the first through third panels together in the outgoing mailer configuration when the sheet is Z-folded about the fold lines 24,26, as illustrated in FIG. 3. In the preferred embodiment, illustrated in the drawings, the adhesive patterns include discontinuous strips 58,60 provided on the first face of the first and second panels in tear off strips 54,56 and discontinuous strips 62,64 provided on the second face of the second and third panels in the tear off strips 56,54 respectively.

The Z-fold adhesive patterns also preferably include one or more strips or segments for adhering the top and bottom edges of the Z-folded mailer. Thus, in the illustrated embodiment, pressure seal cohesive 66,68 is provided adjacent the top edge 12 of the mailer and adjacent the second fold line 26 for cooperating to adhere the first and second panels 28,30 in the Z-fold configuration and further adhesive segments 70,72 are provided adjacent the first fold line 24 and the bottom edge 14 of the mailer on the second face 22 of the intermediate 10 to adhere the second and third panels 30,32 in the Z-folded configuration. Such adhesive patterns are preferably provided discontinuously on the respective edges of the first, second and third panels to facilitate disengagement of these edges by the end user with a letter opener or index finger, as shown in FIG. 4. The cohesive 70 provided for example on the second face 22 of the mailer is preferably limited, as shown, as that portion of the mailer intermediate is retained as a part of the reply envelope albeit on the back side of the reply envelope. Similarly, a portion of the cohesive 66 is retained on a part of the statement in the illustrated embodiment and thus is preferably minimized in dimension. As a further alternative, however, a line of weakness (not shown) can be provided parallel to the first edge 12 of the mailer to allow the end user to detach that portion of the statement bearing the cohesive. It is to be understood, however, that providing a further line of weakness for removing the adhesive strips adjacent the first edge further limits the space available for printed indicia and information.

Most preferably, the adhesive for adhering the intermediate in the Z-fold mailer configuration is a substantially permanent adhesive that is defined by pressure seal adhesive or cohesive for sealing the mailer upon folding and the application of suitable pressure to the adhesive regions. In the alternative, however, the adhesive may be a re-wettable adhesive, pressure sensitive adhesive covered by a release strip. Also, the adhesive may be provided as continuous elements rather than discontinuous elements and/or in a pattern, shape or density other than that shown. Thus, the adhesive areas or patterns 58, 60, 62, 64, 66, 68, 70, 72 may take any configuration, not just dash line configuration as illustrated in FIGS. 1 and 2. However, it is preferred that the amount and spacing of such adhesive material be sufficient to allow the mailer to be processed by U.S. postal service automated systems.

Figure 5:
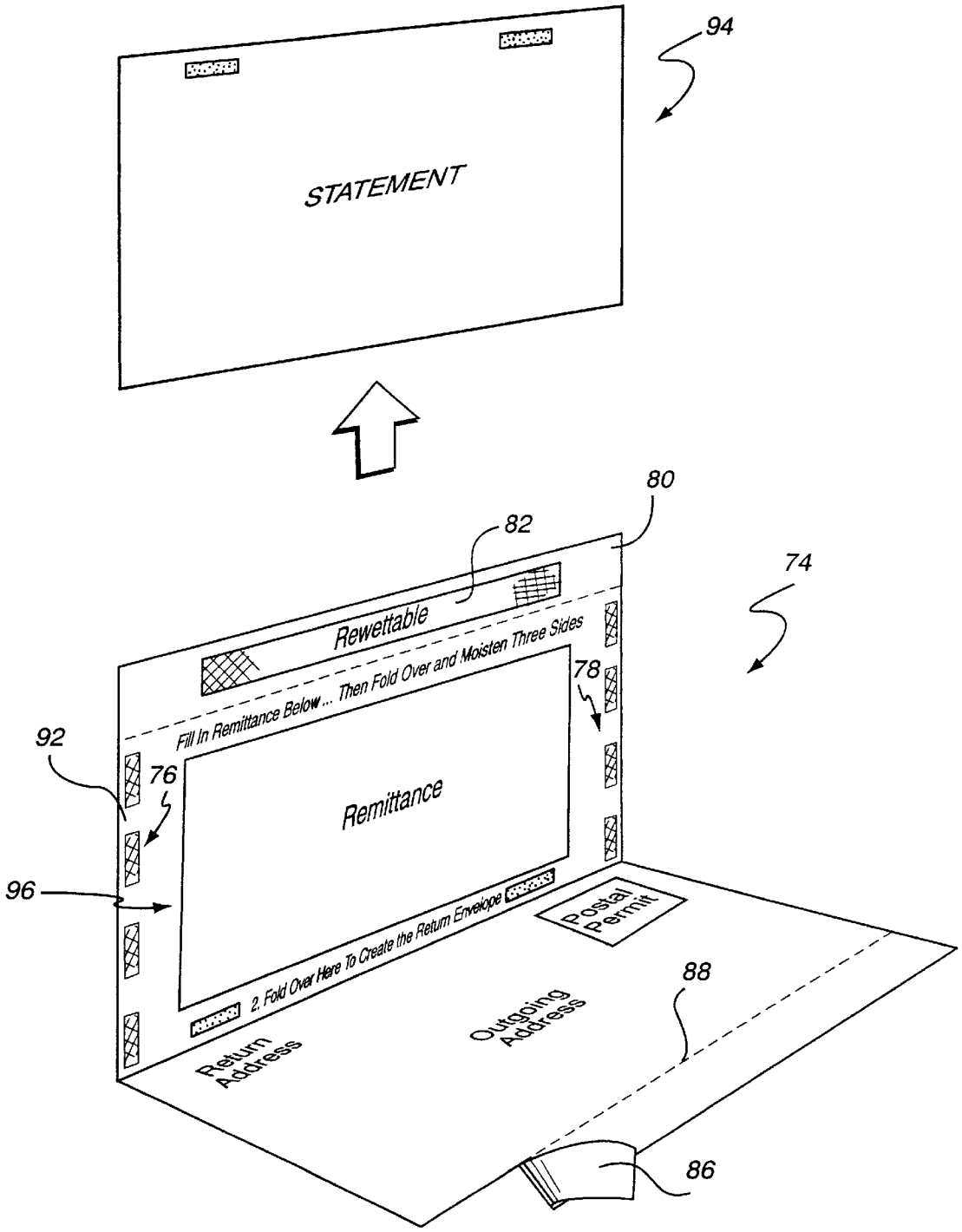
FIG. 5 is an exploded perspective view showing the removal of the statement or invoice and assembly of a reply envelope according to an exemplary embodiment of the invention.
Figure 6:
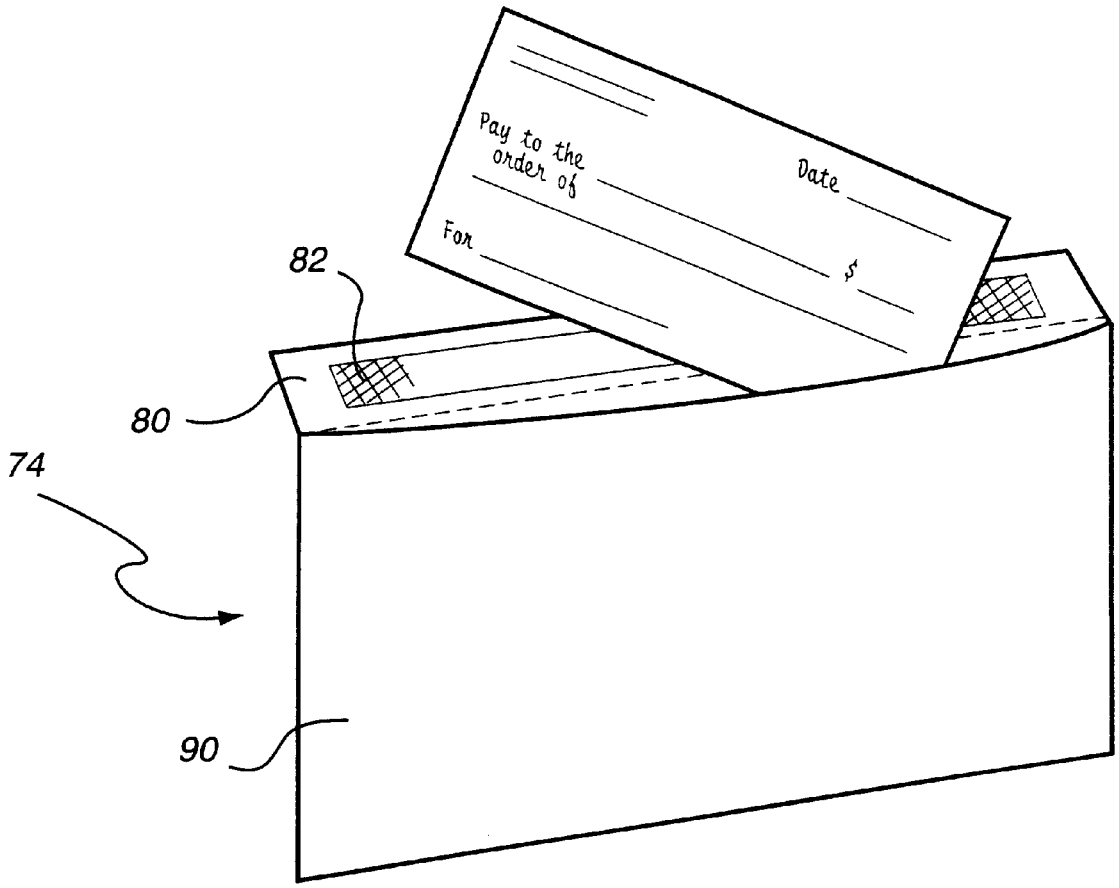
FIG. 6 is a perspective view showing the insertion of a check into the formed reply envelope.

A plurality of adhesive patterns are further defined on the first and second faces of the intermediate 10 to define two of the panels into a reply envelope. In the illustrated embodiment, the second and third panels 30,32 are adapted to define the reply envelope 74 (FIGS. 5 and 6). Thus, a first adhesive pattern comprised of activatable adhesive areas 76,78 is provided on the first face 22 of at least one of the second and third panels 30,32 and most preferably on the first face of the second panel 30. Because the second and third panels that define the reply envelope are joined at fold line 26, adhesive for defining the reply envelope is unnecessary along the second fold line.

According to the invention, the adhesive areas or patterns 76,78 provided for forming the reply envelope 74 are preferably an activatable adhesive such as a re-wettable adhesive, so as not to adhere to an adjacent facing panel until the reply envelope is to be formed. In the alternative, however, a pressure sensitive adhesive can be provided with a removable liner covering and protecting the same during initial transmission of the Z-fold mailer, to be removed by the end user when the reply envelope is assembled.

The second panel further comprises a reply envelope closing flap 80 having an activatable adhesive 82 on the first face thereof for sealing the reply envelope. More specifically, a line of weakness 84 is defined to extend to and between the first and second lines of weakness 50,52 of the second panel. The line of weakness 84 may be a perforated line or die cut line or may be a scored or a crease line. The adhesive 82 is provided on the first face of the thus defined flap 80, to secure the reply envelope in a sealed configuration. The patterns of adhesive 76, 78, 82 may be a re-wettable adhesive or may be a pressure sensitive adhesive that is covered and protected prior to sealing the reply envelope by a removable liner or the like. Other alternatives such as a cohesive that adheres to a counterpart adhesive pattern provided on the second face of the third panel may be provided. The adhesive areas or patterns 76,78,82 may have variations in composition and configuration as described above with respect to areas 58,60,62,64.

Additional lines of weakness (not shown) may be defined in the second and third panels to facilitate opening of the reply envelope at the remittance center to retrieve the remittance and the remittance statement as described below.

The third panel 32 includes a removable stub 86 defined by line of weakness 88 to allow the reply envelope flap 80 to be adhered to the second side of the third panel, which defines the rear panel of the reply envelope. Preferably the portion of the third panel defining the rear panel of the reply envelope has a transverse dimension not greater than and preferably slightly less than the transverse dimension of the front panel of the reply envelope. In an exemplary embodiment, the removable stub 86 has a transverse dimension of about 1 inch so that the resulting rear panel 90 of the reply envelope has a transverse dimension about 3⅔ inches, although the dimension of the rear panel of the reply envelope may correspond identically to the dimensions of the front panel 92 thereof.

Indicia may be printed where ever desired although at least with respect to the first face 20 of the third panel 32 and the second face 22 of the second panel 30 the printed indicia is preferably limited to address and postal indicia 36,38,40, 44,46,48. Various indicia and information may be printed on the first face 20 of the second panel 30 to instruct the end user to complete the remittance advice and how to assembly the reply envelope, on the first face 20 of the first panel 28 to instruct the end user as to the detachment of the statement portion of the mailer, and on the second face 22 of the first panel 28 and the second face 22 of the third panel 32 to instruct the end user on opening the Z-fold mailer and stub removal for forming the reply envelope, as shown in FIG. 2. Other indicia may be provided as deemed necessary or desirable to instruct and direct the end user and/or as advertising, particularly on the second face 22 of the third panel 32. Although not shown, detachable tractor drive strips may be provided for the intermediate during processing. Such strips are conventional for facilitating handling of the intermediate for printing or the like during manufacture of the mailer. Such strips are typically provided where the intermediate is in continuous form, wherein the top and bottom edges 12,14 are lines of weakness between longitudinally adjacent intermediates 10. During normal processing, such strips (not shown) are slit off at an appropriate stage to expose the side edges 16,18.

In constructing the mailer, after the intermediate 10 is detached from the adjacent intermediates continuously printed therewith (if any) and after slitting of any tractor drive edges (if provided), the intermediate is Z-folded as illustrated in FIG. 3 (typically by conventional folding equipment) and then is run through a suitable sealing machine (typically conventional equipment for either heat sealing or pressure sealing) for activating the adhesive patterns 58,60,62,64,66,68,70,72. Typically, the intermediate as seen in FIGS. 1 and 2 has a length between top and bottom edges 12,14 of at least about 12 inches and more preferably about 14 inches to ensure that all postal specifications are met by both the mailer and the reply envelope. The reply envelope in the illustrated embodiment has a width of about 7½ inches so that it can easily receive a standard (6 inch in length) check therein without folding. In the illustrated embodiment, each panel has a length of about 4⅔ inches and the reply envelope desirably has a flap having a length of about ¾ inch to 1 inch and most preferably about ⅞ inch so that the transverse dimension of the reply envelope is on the order of 3⅔ to 3⅞ and more typically about 3.792 inches to accommodate both the transverse dimension of a full size check therein and to meet postal regulations.

When the outgoing addressee receives the mailer, the panels then comprise first, second and third plies or panels 28,30,32 of the mailer with the first face 20 of the first panel 28 in face to face relation with the first or top face 20 of the second panel 30 and the second face or bottom face 22 of the second panel 30 in face to face relation with the bottom or second face 22 of the third panel 32. The mailer can be easily opened, as illustrated in FIG. 4, by tearing along lines of weakness such as perforation lines 50,52 and by disrupting the adhesive along the top and bottom edges of the mailer with an index finger to disrupt adhesive patterns 66,68 and 70,72. The resultant opened mailer is illustrated in FIG. 5. Ultimately, the statement portion 94 of panel 28 is separated along line 24 as shown by the arrow in FIG. 5. Then stub 86 is detached along the line of weakness 88 of the third panel/ply 32 to define the rear panel of the reply envelope 74. The end user also completes the remittance advice area 96 defined on what will become the rear face of the front panel 92 of the reply. Once the remittance information has been completed, the reply envelope may be assembled by activating the adhesive patterns 76,78 and adhering the rear panel 90 of the reply envelope to panel 92. The adhesive 76,78 is activated by, e.g., wetting or removing the covering release strip, or the like. Thereafter, the check comprising the remittance is inserted into the thus formed reply envelope, as shown in FIG. 6. The completed and filled reply envelope is then sealed by activating the adhesive 82, e.g., by wetting or removing a release strip (not shown) and applying the flap 80 to panel 90.

The intermediate and mailer according to the present invention have a number of advantageous characteristics. All address and postal markings from the original outgoing envelope are hidden in the reply by being disposed as an inner panel of the reply envelope. The reply envelope offers all needed postal encoding for fast delivery and can be printer variable if duplex printing is selected. The design is compact and easy to produce and store using all presently available sealing technology. The reply envelope size allows for the remittance check to be inserted without folding and the removable panel 28/94 may comprise a variety of information including customer invoice copy, discount coupons, or other suitable elements.

It will thus be seen that according to the present invention, a simple and easy to construct, print, and utilize mailer has been provided having a large area available for printable data and a reply envelope which can accept a six inch personal check without folding, and without the need for a window or a patch. The return envelope flap also folds to the back of the reply envelope as is most desirable for ease of use and aesthetics.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and dividing said sheet into substantially equal size first, second, and third panels, an outgoing address area being defined on said first face of said third panel, said outgoing address area being spaced from said first and second side edges;

first and second lines of weakness formed in said first, second and third panels, respectively parallel to and spaced from each of said first and second side edges, said first and second lines of weakness defining tear-off strips providing for ready opening of a mailer constructed by Z-folding said sheet about said fold lines;

a reply address area being defined on said second face of said second panel, said reply address area being spaced from said first and second side edges;

a remittance area being defined on said first face of said second panel;

first adhesive areas provided on said first face of said second panel for defining said second and third panels into a reply envelope that is substantially sealed along first and second side edges thereof, with said remittance area and said outgoing address are disposed on an interior of said reply envelope;

a reply envelope closing flap formed on said second panel, and having a second adhesive area on said first face thereof for sealing the reply envelope along a top edge thereof, said reply envelope closing flap being defined by a third line of weakness formed in said second panel parallel to and spaced from a top edge of of said second panel, said second panel being free from lines of weakness parallel to said top edge in an area between said third line of weakness and said top edge, third adhesive areas provided in at least some of said tear-off strips for holding said first through third panels together as an outgoing mailer when said sheet is Z-folded about said fold lines; and a fourth line of weakness formed in said third panel, parallel to and spaced from a bottom end edge thereof, said fourth line of weakness being spaced from said bottom end edge thereof at least as much as a distance that said third line of weakness is spaced from said top edge of said second panel, said third panel being free from lines of weakness parallel to said bottom edge thereof in an area between said fourth line of weakness and said bottom edge.

2. An intermediate as recited in claim 1, wherein said first panel is disposed between said top edge and said first fold line, said third panel is disposed between said bottom edge and said second fold line, and said second panel is disposed between said first and third panels.

3. An intermediate as recited in claim 2 wherein said first fold line is a line of weakness.

4. An intermediate as recited in claim 1, wherein said first adhesive areas comprise a rewettable adhesive.

5. An intermediate as recited in claim 1, wherein said second adhesive area comprises a rewettable adhesive.

6. An intermediate as recited in claim 1, wherein said third adhesive areas comprise a permanent adhesive.

7. An intermediate as recited in claim 1, wherein said third adhesive areas further include at least one of (1) spaced adhesive segments disposed on said second face of said third panel between said fourth line of weakness and said bottom end edge and (2) spaced adhesive segments disposed on said second face of said second panel between said third line of weakness and said top edge of said second panel, so that when said quadrate sheet of paper is Z-folded about said first and second fold lines to form a mailer, said spaced adhesive segments adhere said second face of said third panel to said second face of said second panel, said spaced, adhered adhesive segments being manually disruptable to disengage said second face of said third panel from said second face of said second panel to open the corresponding edge of the mailer.

8. An intermediate as recited in claim 1 wherein the longest dimension of the interior of the reply envelope formed from said intermediate is at least about six inches, so that the reply envelope can receive an unfolded bank check therein.

9. An intermediate as recited in claim 1 further comprising human readable address indicia imaged in said outgoing address area.

10. An intermediate as recited in claim 1 wherein the distance between said top and bottom edges of the unfolded sheet is at least about twelve inches.

11. An intermediate as recited in claim 10 wherein the distance between said top and bottom edges of the unfolded sheet is about fourteen inches.

12. A mailer type business form, comprising:

first, second, and third substantially equal size quadrate substantially opaque panels, said second panel being sandwiched between said first and third panels, and each panel having a top face and a bottom face, first and second side edges, and first and second end edges;

remittance stub indicia provided on said top face of said second panel;

reply address indicia provided on said bottom face of said second panel;

outgoing address indicia provided on said top face of said third panel;

first adhesive patterns provided on said second panel top face for defining said second and third panels into a reply envelope that is substantially sealed along first and second side edges thereof;

a reply envelope closing flap formed by a fold line defined in said second panel in parallel, spaced relation to said first end edge thereof and having activatable adhesive on said top face thereof for sealing the reply envelope, said second panel being free from lines of weakness parallel to said first end edge thereof in an area between said fold line and said first end edge;

first and second lines of weakness formed in said first, second and third panels, respectively parallel to and spaced from each of said first and second side edges thereof;

said first and second lines of weakness defining tear-off strips providing for ready opening of the mailer; and permanent adhesive areas provided in at least some of said tear-off strips for holding said first through third panels together, wherein said first end edge of said third panel is coupled to said second end edge of said second panel, and further comprising a third line of weakness formed in said third panel parallel to said second end edge thereof and spaced from said second end edge the same distance said fold line is spaced from said first end edge of said second panel, said third panel being free from lines of weakness parallel to said second end edge thereof in an area between said third line of weakness and said second end edge.

13. A mailer as recited in claim 12, wherein said permanent adhesive areas further include at least one of (1) spaced adhesive segments disposed on said bottom face of said third panel between said third line of weakness and said second end edge thereof and (2) spaced adhesive segments disposed on said bottom face of said second panel between said first end edge and said fold line thereof, said spaced adhesive segments adhering said second face of said third panel to said second face of said second panel, said spaced, adhered adhesive segments being manually disruptable to disengage said bottom face of said third panel from said bottom face of said second panel to open the corresponding edge of the mailer.

14. A mailer as recited in claim 12 wherein said first, second and third panels are of paper, and wherein said first, second and third panels are connected together at mutually adjacent end edges as an integral sheet of paper.

15. An intermediate for a mailer type business form, consisting of:

a quadrate sheet of paper having parallel top and bottom edges, parallel first and second side edges perpendicular to the top and bottom edges, and first and second faces;

first and second fold lines parallel to said top and bottom edges, and dividing said sheet into substantially equal size first, second, and third panels, an outgoing address area being defined on said first face of said third panel, said outgoing address area being spaced from said first and second side edges;

human readable address indicia imaged in said outgoing address area;

first and second lines of weakness formed in said first, second and third panels, respectively parallel to and spaced from each of said first and second side edges, said first and second lines of weakness defining tear-off strips providing for ready opening of a mailer constructed by Z-folding said sheet about said fold lines;

a reply address area being defined on said second face of said second panel, said reply address area being spaced from said first and second side edges;

a remittance area being defined on said first face of said second panel;

first adhesive areas provided on said first face of said second panel for defining said second and third panels into a reply envelope that is substantially sealed along first and second side edges thereof, with said remittance area and said outgoing address are disposed on an interior of said reply envelope;

a reply envelope closing flap formed on said second panel, and having a second adhesive area on said first face thereof for sealing the reply envelope along a top edge thereof, said reply envelope closing flap being defined by a third line of weakness formed in said second panel parallel to and spaced from a top edge thereof, third adhesive areas provided in at least some of said tear-off strips for holding said first through third panels together as an outgoing mailer when said sheet is Z-folded about said fold lines;

a fourth line of weakness formed in said third panel, parallel to and spaced from a bottom end edge thereof, said fourth line of weakness being spaced from said bottom end edge thereof at least as much as a distance that said third line of weakness is spaced from said top edge of said second panel; and wherein said third adhesive areas further include at least one of (1) spaced adhesive segments disposed on said second face of said third panel between said fourth line of weakness and said bottom end edge and (2) spaced adhesive segments disposed on said second face of said second panel between said third line of weakness and said top edge of said second panel, so that when said quadrate sheet of paper is Z-folded about said first and second fold lines to form a mailer, said spaced adhesive segments adhere said second face of said third panel to said second face of said second panel, said spaced, adhered adhesive segments being manually disruptable to disengage said second face of said third panel from said second face of said second panel to open the corresponding edge of the mailer.

16. An intermediate as recited in claim 15, wherein said first fold line is a line of weakness.

17. An intermediate as recited in claim 15, wherein said first adhesive areas comprise a rewettable adhesive.

* * * * *